US010760309B1

(12) United States Patent
Bowman

(10) Patent No.: US 10,760,309 B1
(45) Date of Patent: Sep. 1, 2020

(54) DOOR STOP

(71) Applicant: Ryan David Bowman, Waterville, ME (US)

(72) Inventor: Ryan David Bowman, Waterville, ME (US)

( * ) Notice: Subject to any disclaimer, the term of this patent is extended or adjusted under 35 U.S.C. 154(b) by 0 days.

(21) Appl. No.: 16/196,638

(22) Filed: Nov. 20, 2018

Related U.S. Application Data

(60) Provisional application No. 62/717,139, filed on Aug. 10, 2018, provisional application No. 62/727,188, filed on Sep. 5, 2018.

(51) Int. Cl.
*E05C 17/54* (2006.01)

(52) U.S. Cl.
CPC ..... *E05C 17/54* (2013.01)

(58) Field of Classification Search
CPC ..... E05C 17/54; E05C 19/18; E05C 19/182; Y10T 292/71; Y10T 292/73; Y10T 292/34; Y10T 292/876
USPC ..... 16/82, 86 R, 86 A; D8/402, 47
See application file for complete search history.

(56) References Cited

U.S. PATENT DOCUMENTS

| | | | | | |
|---|---|---|---|---|---|
| 1,945,932 | A * | 2/1934 | Caley | A45D 2/18 | 132/247 |
| 4,700,408 | A * | 10/1987 | Winger | F16M 13/04 | 24/3.13 |
| D309,708 | S * | 8/1990 | Rosa | D8/402 | |
| 5,011,203 | A * | 4/1991 | Tackett | E05C 17/54 | 292/343 |
| 5,680,675 | A * | 10/1997 | Davis | E05C 17/025 | 16/83 |
| 6,276,029 | B1 * | 8/2001 | Buettell | A44C 5/0007 | 24/16 PB |
| 7,644,964 | B2 * | 1/2010 | Bushey | E05C 17/54 | 16/82 |
| 8,850,675 | B2 * | 10/2014 | Frydlewski | A43B 3/0078 | 24/712 |
| 2009/0039660 | A1 * | 2/2009 | Gonzalez | C09K 21/10 | 292/342 |

* cited by examiner

*Primary Examiner* — Jeffrey O'Brien
(74) *Attorney, Agent, or Firm* — Michael D. Eisenberg

(57) ABSTRACT

A portable door stop comprising a wedge shaped unit, a first arm, and second arm. The wedge shaped unit has a tapered front end and an enlarged back end and tapers from the back end to the front end. The first arm and the second arm extend away from the wedge shaped unit and are configured for being removably engageable to each other to form a loop. The wedge shaped unit is configured for being pushed in a gap between a door and a floor under the door to prevent the door from moving, while the first and second arms are configured for enabling the portable door stop to be removably joined to a desired object by forming the loop around a portion of the desired object.

8 Claims, 8 Drawing Sheets

DOOR STOP

TECHNICAL FIELD

The present application, in some embodiments thereof, relates to door holding devices, such as door stops.

BACKGROUND

In the past few years, several shootings have rocked the United States. In each case, a lone shooter entered a building, such as a school, and walked into several rooms of the building to shoot innocent victims. When a door was locked or barricaded, the shooter proceeded to the next room, and the people in the locked or barricaded room were saved.

Moreover, in many hotels, the hotel's staff have access to the rooms and the travelers may find it uncomfortable to stay in rooms that are accessible to strangers. Therefore, the travelers may find it comforting to barricade their hotel doors while staying inside the rooms.

U.S. Pat. No. 7,014,229 discloses a door stop and holder apparatus including a generally wedge shaped stop member connected by a tether member to a hollow receptacle member the rear face of which is affixed to a door and the front face of which is provided with at least one receptacle element dimensioned to receive a portion of a bumper member that projects outwardly from the front face of the holster member.

BRIEF SUMMARY OF THE INVENTION

There is therefore a need for a device to prevent the opening of door that is easy to carry, hard to misplace, and that allows users to have quick access to the device in a time of need or in an urgent situation.

The inventor has found that traditional door stops are designed with the intent of only keeping a door open in mind and not designed to also prevent a door from opening. Therefore, a traditional door stop is normally kept on the floor next to a door, in a cluttered drawer, or inside a cluttered bag where it can be lost or misplaced, making it hard to find in a time of need or an urgent situation. The holder apparatus of U.S. Pat. No. 7,014,229 is joined to the door and is therefore not configured for being carried.

Therefore an aspect of some embodiments of the present invention relates to a portable door stop comprising a wedge shaped unit, a first arm, and second arm. The wedge shaped unit has a tapered front end and an enlarged back end and tapers from the back end to the front end. The first arm and the second arm extend away from the wedge shaped unit and are configured for being removably engageable to each other to form a loop. The wedge shaped unit is configured for being pushed in a gap between a door and a floor under the door to prevent the door from moving, while the first and second arms are configured for enabling the portable door stop to be removably joined to a desired object by forming the loop around a portion of the desired object.

In a variant, the first arm has an elastic section comprising an opening with a first dimension, while the second arm comprises a bulge having a second dimension larger than the first dimension of opening. The first arm and the second arm are configured to be joined by causing the bulge to cross the opening, thereby causing the opening to expand while the bulge is in the opening and to contract back to the first dimension after the bulge has exited the opening.

In another variant, the first arm and the second arm are integral with the wedge shaped unit.

Optionally, the door stop is made of a rubber material.

The door stop may be fabricated via injection molding.

In yet another variant, the first arm and the second arm are fabricated separately from the wedge shaped unit and are joined to the wedge shaped unit.

In a further variant, the first arm or the second arm extends away from any of: the front end of the wedge shaped unit, the back end of the wedge shaped unit, a top of the wedge shaped unit, a side wall of the wedge shaped unit, and a bottom of the wedge shaped unit.

In yet a further variant, the first arm comprises one or more buttons extending away from a face of the first arm, while the second arm comprises one or more holes configured for removably engaging with the one or more buttons, in order to removably join the second arm with the first arm.

In some embodiments of the present invention, the first arm comprises a first strip of a hook-and-loop fastener joined to a face of the first arm, while the second arm comprises a second strip the hook-and-loop fastener configured to engage with the first strip for removably joining the second arm to the first arm.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
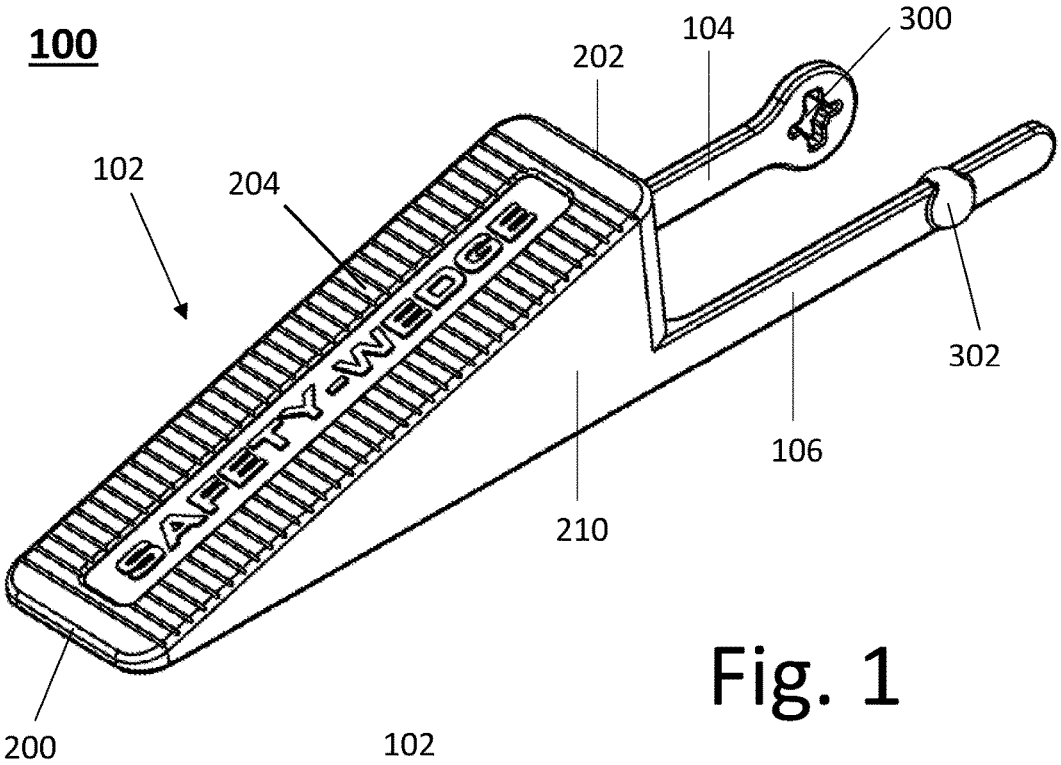
FIG. 1 is perspective view of a door stop, according to some embodiments of the present invention, showing the front, top, and side of the door stop.
Figure 2:
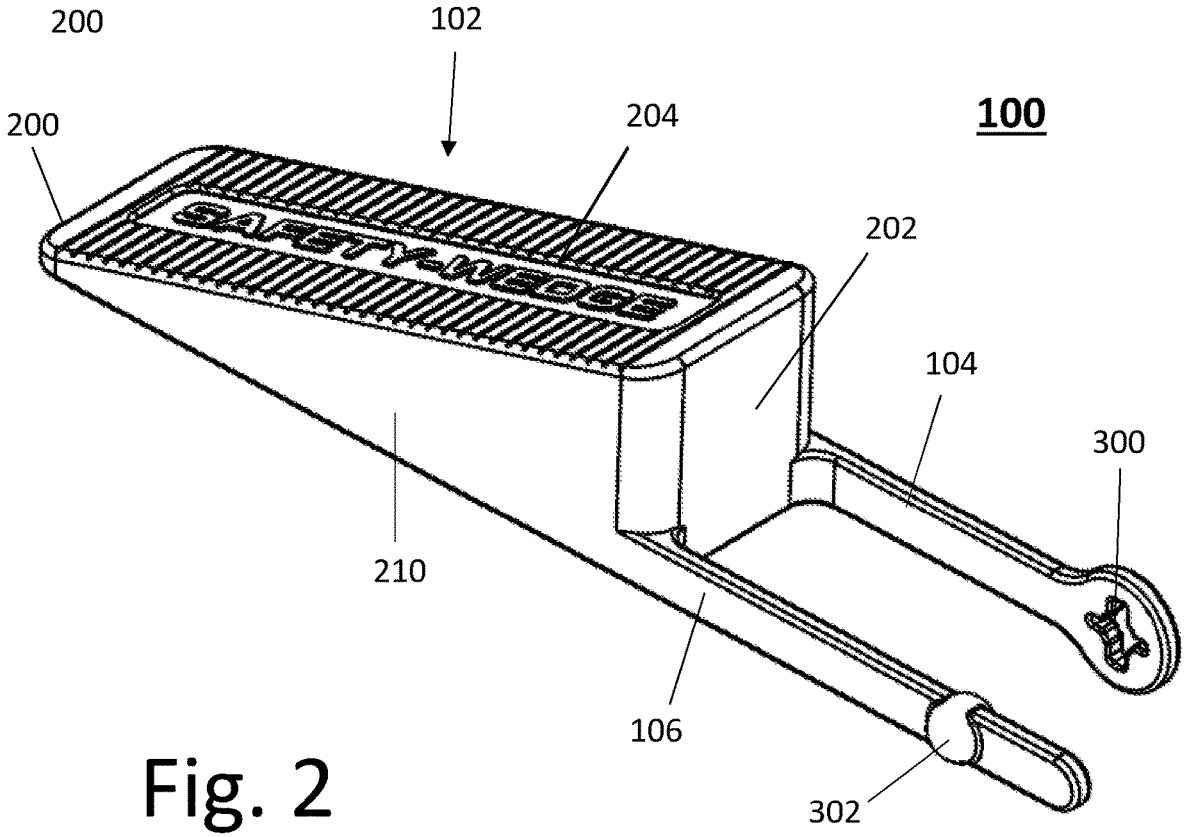
FIG. 2 is perspective view of a door stop, according to some embodiments of the present invention, showing the back, top, and side of the door stop.
Figure 3:
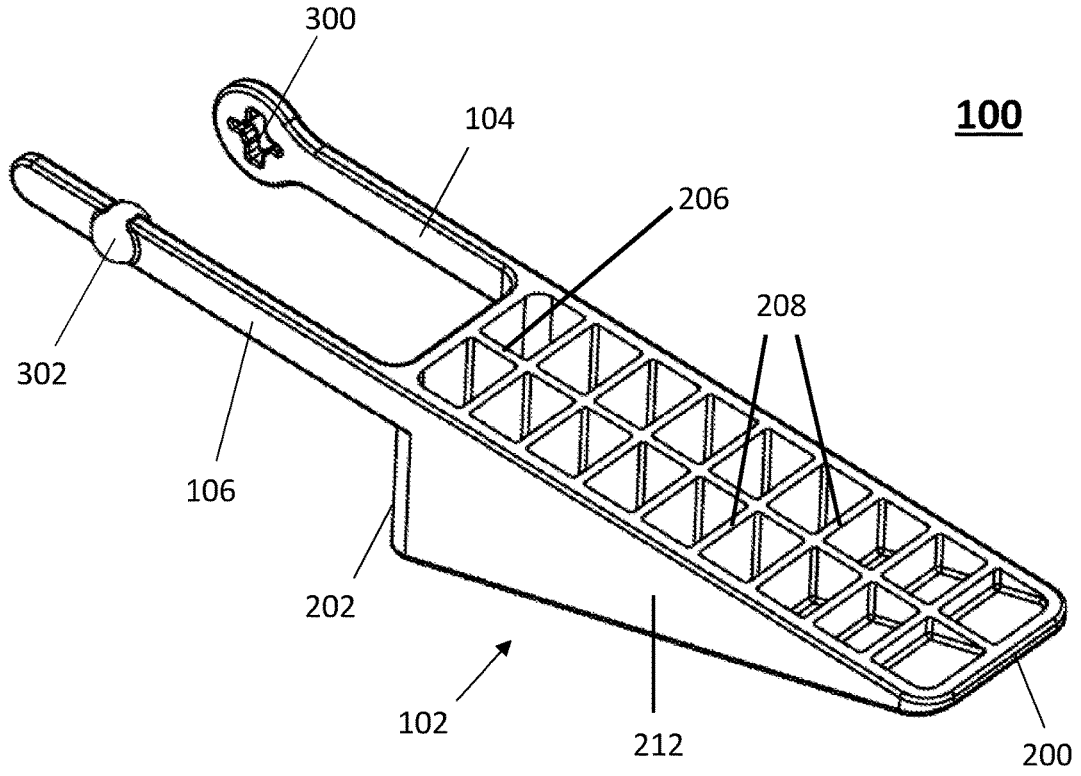
FIG. 3 is a bottom view of a door stop, according to some embodiments of the present invention, showing internal ribbing that provides structural support.
Figure 4:
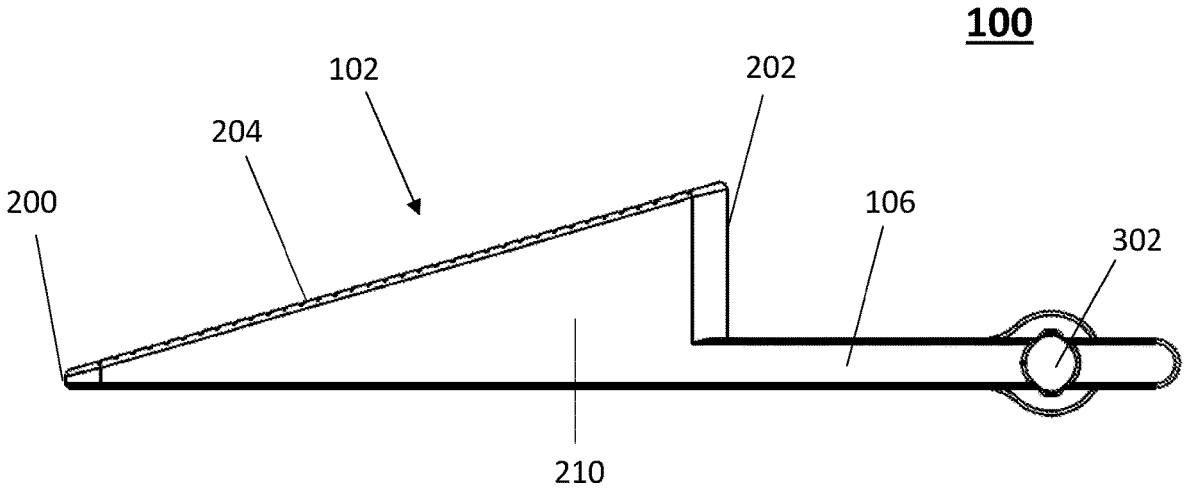
FIG. 4 is a side view of a door stop, according to some embodiments of the present invention.
Figure 5:
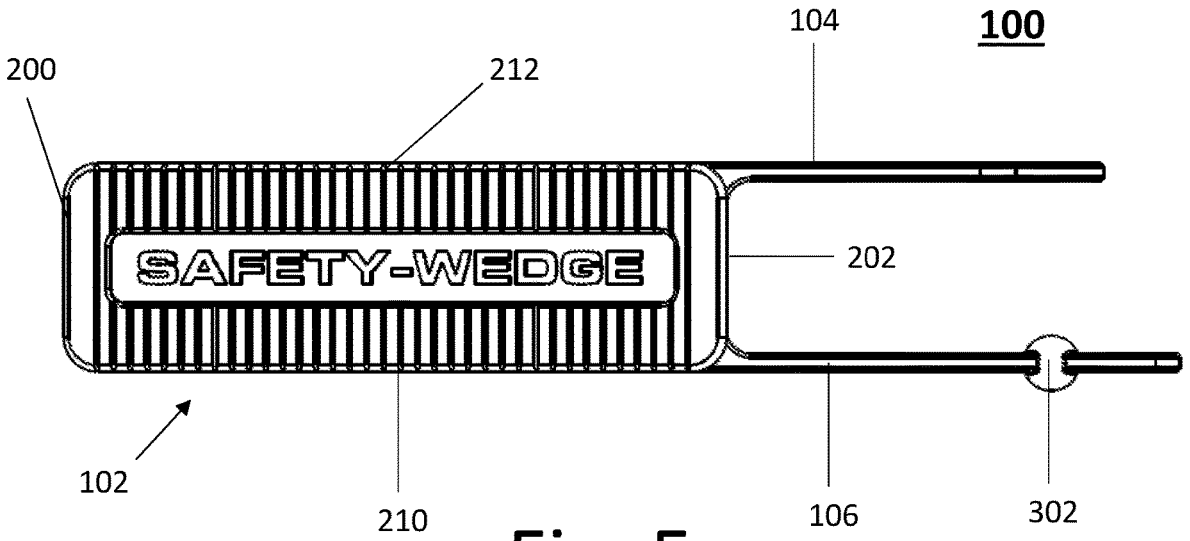
FIG. 5 is the top view of a door stop, according to some embodiments of the present invention.
Figure 6:
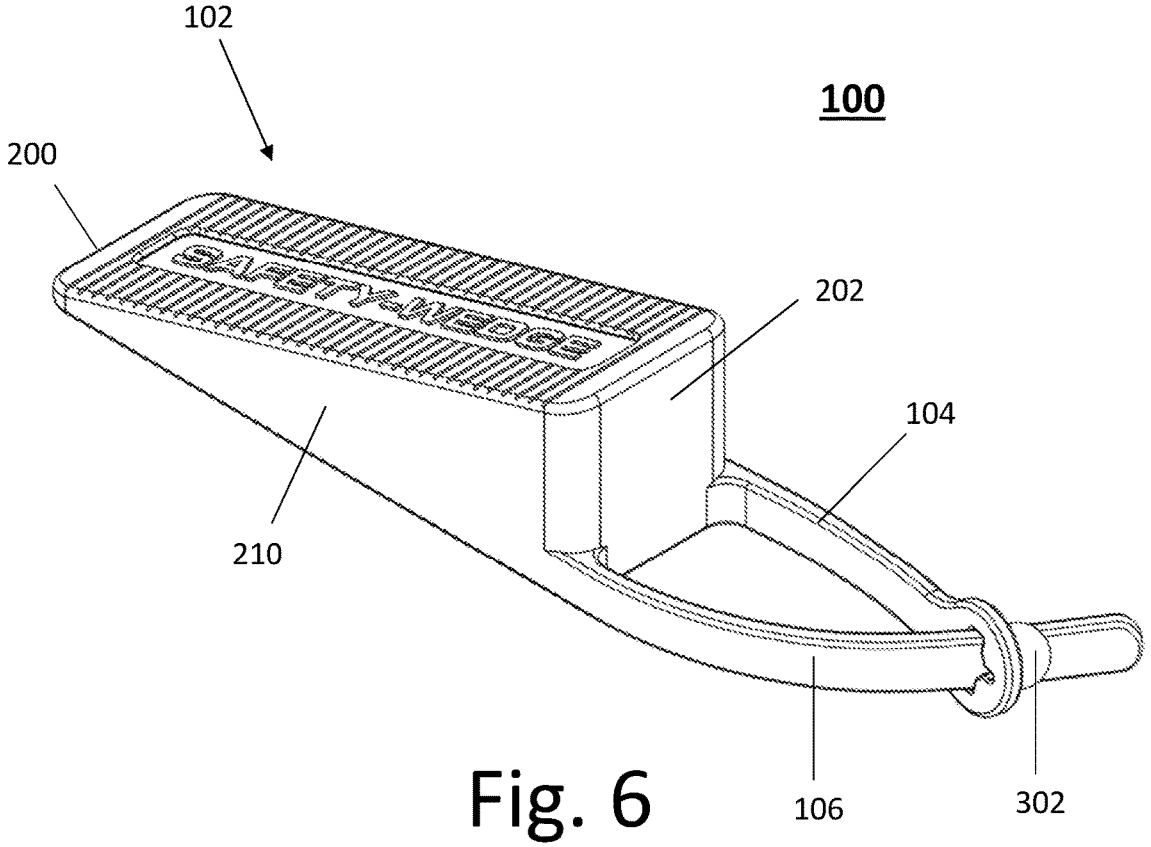
FIG. 6 is a perspective view of a door stop of the present invention, in which the arms are joined together to form a loop.

Referring now to FIGS. 1-6, FIG. 1 is perspective view of a door stop 100, according to some embodiments of the present invention, showing the front, top, and side of the door stop 100. FIG. 2 is perspective view of the door stop 100 showing the back, top, and side of the door stop. FIG. 3 is a bottom view of the door stop 100, showing internal ribbing that provides structural support. FIG. 4 is a side view of the door stop 100, according to some embodiments of the present invention. FIG. 5 is the top view of the door stop 100, according to some embodiments of the present invention. FIG. 6 is a perspective view of the door stop 100 of the present invention, in which the arms are joined together to form a loop.

The door stop 100 includes a wedge shaped unit 102, a first arm 104, and a second arms 106. The wedge shaped unit 102 has a tapered front end 200 and an enlarged back end 202, and tapers from the enlarged back end 202 to the tapered front end 200. The wedge shaped unit 102 is configured for being inserted into the space between a door and a floor in order to keep the door open or in order to prevent a door from opening.

In some embodiments of the present invention, the wedge shaped unit 102 has a top face 204 with a grip texture to enable increase the grip on the bottom of the door. In some embodiments of the present invention, the wedge shaped unit 102 is made of a solid piece of elastic material. Alternatively, the wedge shaped unit 102 is hollow and includes one or more longitudinal ribs 206 and one or more transversal ribs 208, as shown in FIG. 3. The longitudinal ribs 206 extend in the hollow space between the front end 200 and the back end 202. The transversal ribs 208 extend in the hollow space between the side walls 210 and 212. The ribs 206 and 208 provide structural support to the wedge shaped unit 102 and prevent the wedge shaped unit to collapse under an external force.

To keep the door open, the wedge shaped unit 102 can be slid between the door and the floor front end 200 first, and can be pushed from the enlarged back end 202 toward the door while the door is pulled into the wedge shaped unit 102 to firmly secure placement of the wedge shaped unit 102. To secure a door in the closed position, the wedge shaped unit 102 is slid into the gap between the door and floor front end 200 first, then the wedge shaped unit 102 is pushed toward the door from the back end 202, until it feels the wedge shaped unit 102 cannot be pushed any longer.

When the wedge shaped unit 102 is securely wedged between the door and floor, the grip texture and internal ribs of the wedge shaped unit 102 are configured for preventing forces applied to the door (either to close or to open the door) from easily moving the door from its current position.

Figure 7:
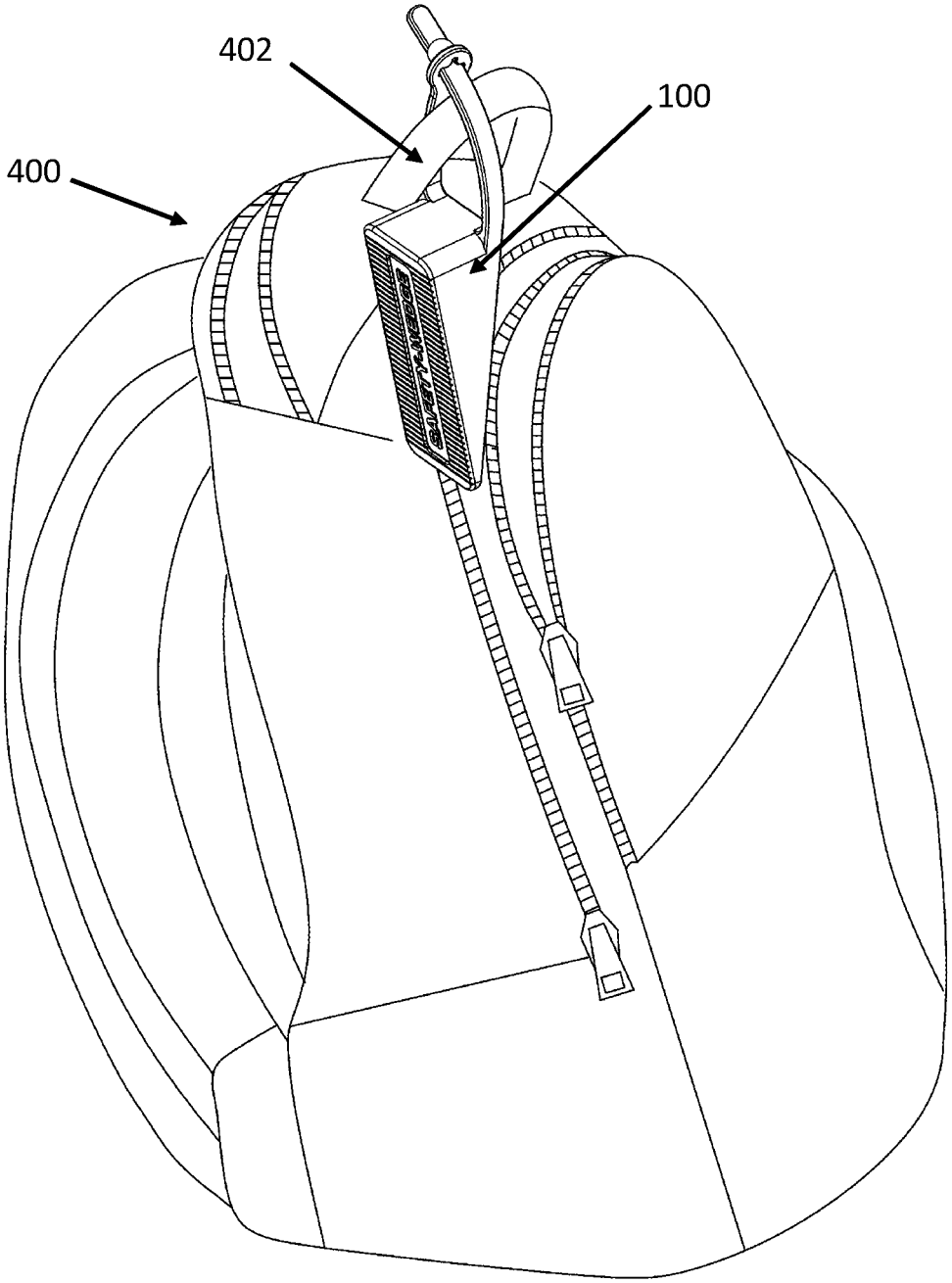
FIG. 7 is a perspective view of a door stop of the present invention, removably attached to a backpack.

The first arm 104 and the second arm 106 extend away from the wedge shaped unit 102. The first arm 104 and the second arm 106 are flexible and are configured for being removably joinable to each other in order to form a loop, as seen in FIG. 6. This enables the door stop 100 to be attached to different types of items for storage, such as a backpack, tool-belts, paint-buckets, or other items that make it easy to find the door stop 100 in the most stressful of situations, so the user can quickly remove it for immediate use. FIG. 7 shows an example in which the door stop 100 is attached to a handle 402 of a backpack 400, by joining the first arm and the second arms together to create a loop around the handle 402.

Figure 8:
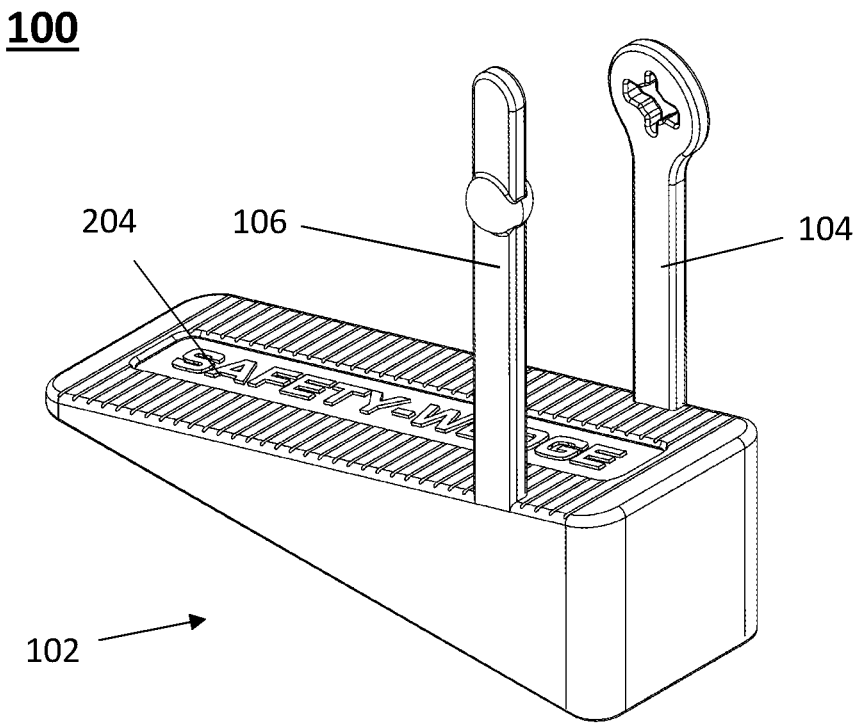
FIG. 8 is a perspective view of a door step of the present invention, in which the arms extend from the from the top face of the wedge shaped unit.
Figure 9:
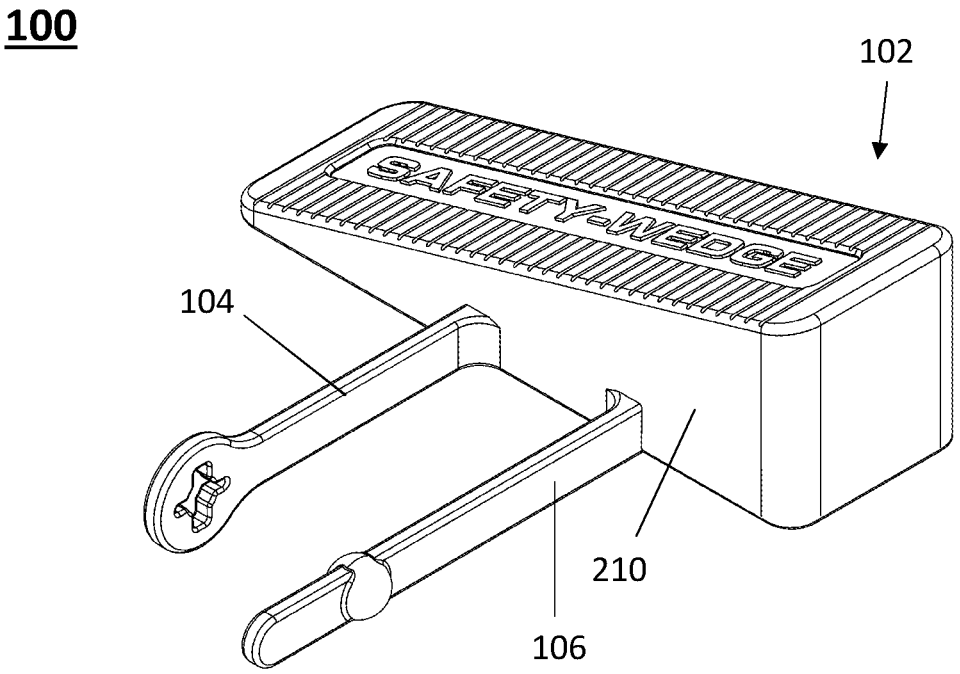
FIG. 9 is a perspective view of a door step of the present invention, in which the arms extend from the from a side of the wedge shaped unit.
Figure 10:
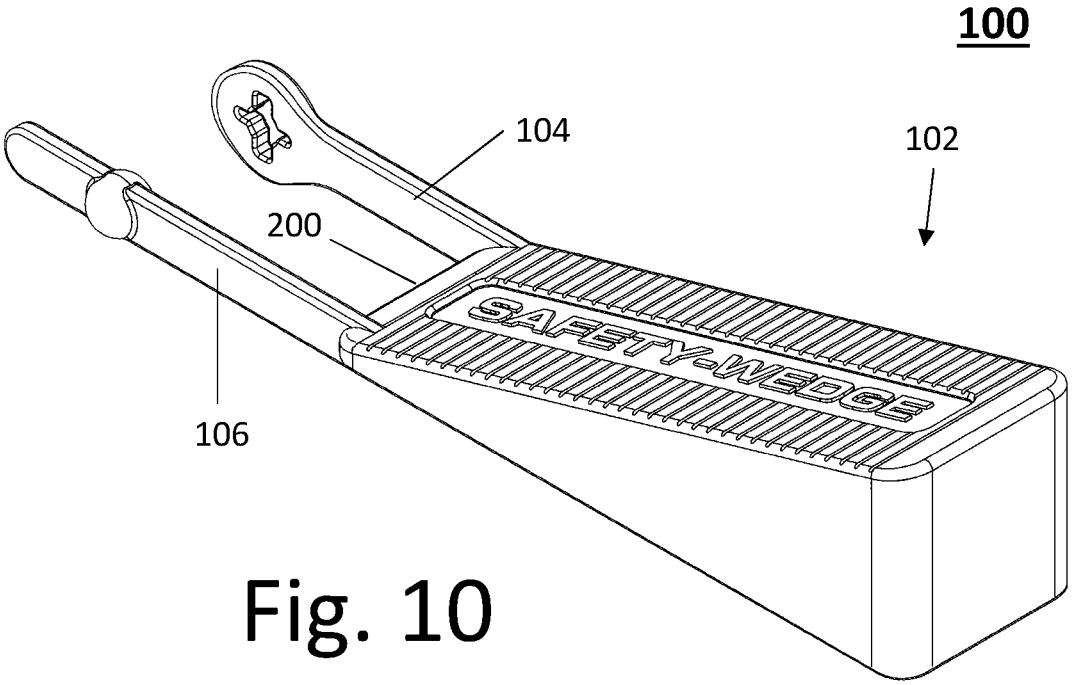
FIG. 10 is a perspective view of a door step of the present invention, in which the arms extend from the from the front end of the wedge shaped unit
Figure 11:
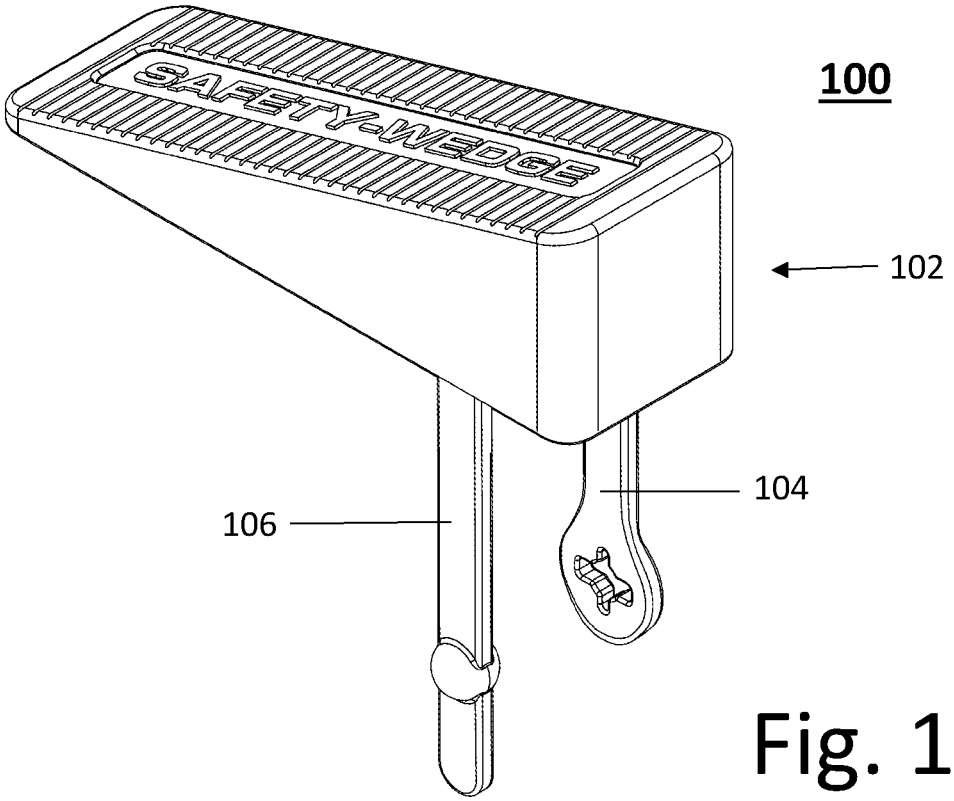
FIG. 11 is a perspective view of a door step of the present invention, in which the arms extend from the from the bottom of the wedge shaped unit.
Figure 12:
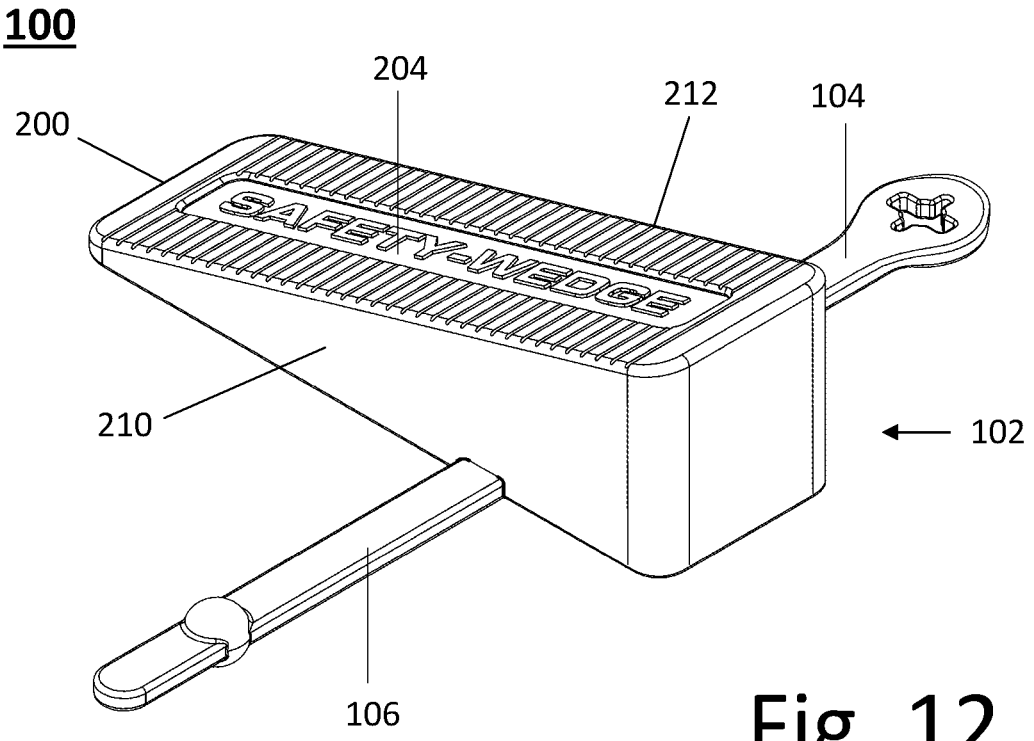
FIG. 12 is a perspective view of a door step of the present invention, in which each arm extends from a respective side of the wedge shaped unit.

In the example of FIGS. 1-7, the arms extend from the back end 202 of the wedge shaped unit 102. It should be noted that arms may extend away from any portion of the wedge shaped unit, as shown in the examples if FIGS. 8-12. In the example of FIG. 8, the arms 104 and 106 extend from the from the top face 204 of the wedge shaped unit 102. In the example of FIG. 9, the arms 104 and 106 extend from the from a first side 210 of the wedge shaped unit 102. In the example of FIG. 10, the arms 104 and 106 extend from the from the front end 200 of the wedge shaped unit 102. In the example of FIG. 11, the arms 104 and 106 extend from the from the bottom of the wedge shaped unit 102. In the example of FIG. 12, the first arm 104 extends from the second side 212, while the second arm 106 extends from the first side 210. Any other configuration may be used and is within the scope of the present invention.

In some embodiments of the present invention (as shown in FIGS. 1-12), the first arm 104 is elastic and has an opening 300, while the second arm 106 includes a bulge 302 larger than the opening 300. In order to join the arms and form a loop, the second arm 106 is inserted into the opening 300 of the first arm 104 until the bulge 302 reaches the opening 300. The end of the second arm 106 is then pulled so that the bulge 302 stretches the elastic material encompassing the opening 300 to allow the bulge 302 to traverse the opening from one side thereof to the other side thereof. After the bulge 302 has passed through the opening 300, the elastic material surrounding the opening 300 contracts back to its default configuration and the opening 300 returns to its original size and prevents the bulge 302 from traversing the opening 300. In order to detach the arms from each other, the second arm 106 is pulled away from the first arm in order to pull the bulge 302 through the opening 300, expanding the opening 300 and allowing passage thereof through the opening 300.

Figure 13:
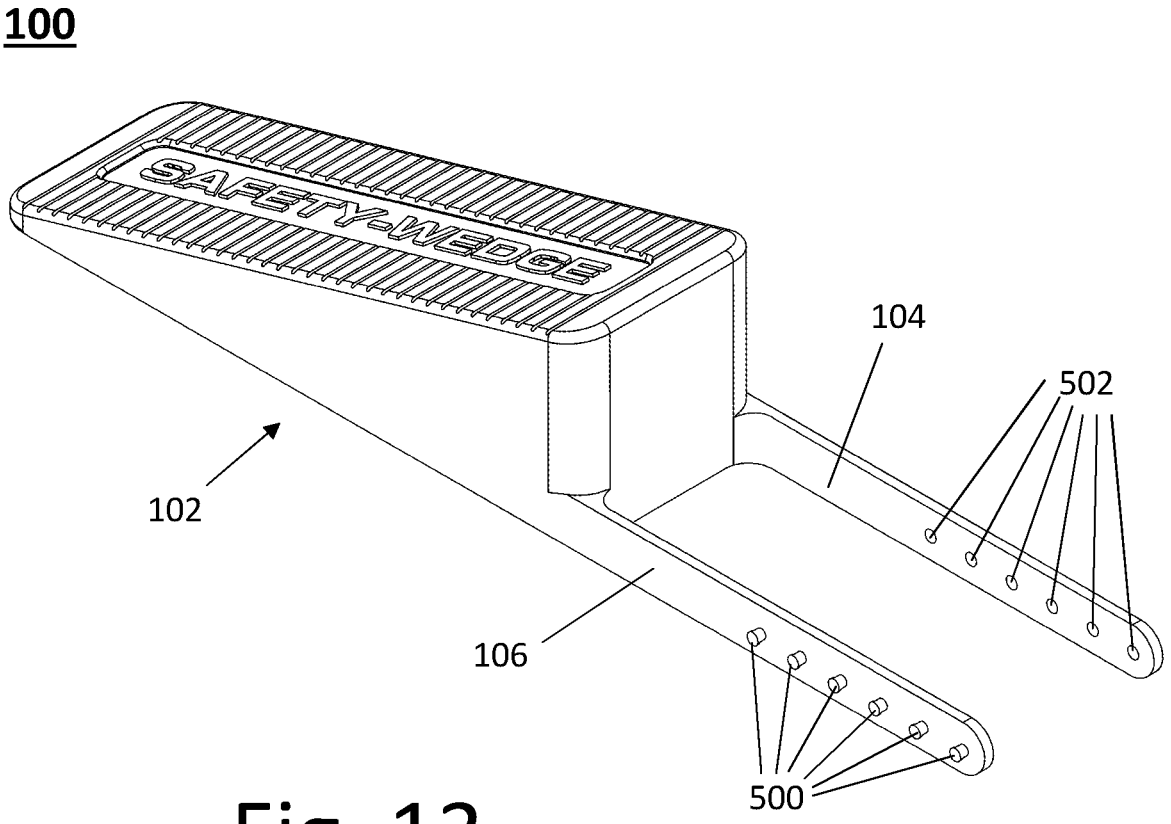
FIG. 13 is a perspective view of a door step of the present invention, in which the second arm includes one or more buttons extending away from a face of the second arm, while the first arm include one or more holes configured for engaging with the one or more buttons for joining to the second arm.

In some embodiments of the present invention, as illustrated in FIG. 13, the second arm 106 includes one or more buttons 500 extending away from a face of the second arm 106, while the first arm 104 includes one or more holes 502 configured for removably engaging (snapping) with the one or more buttons for joining to the second arm 106.

Figure 14:
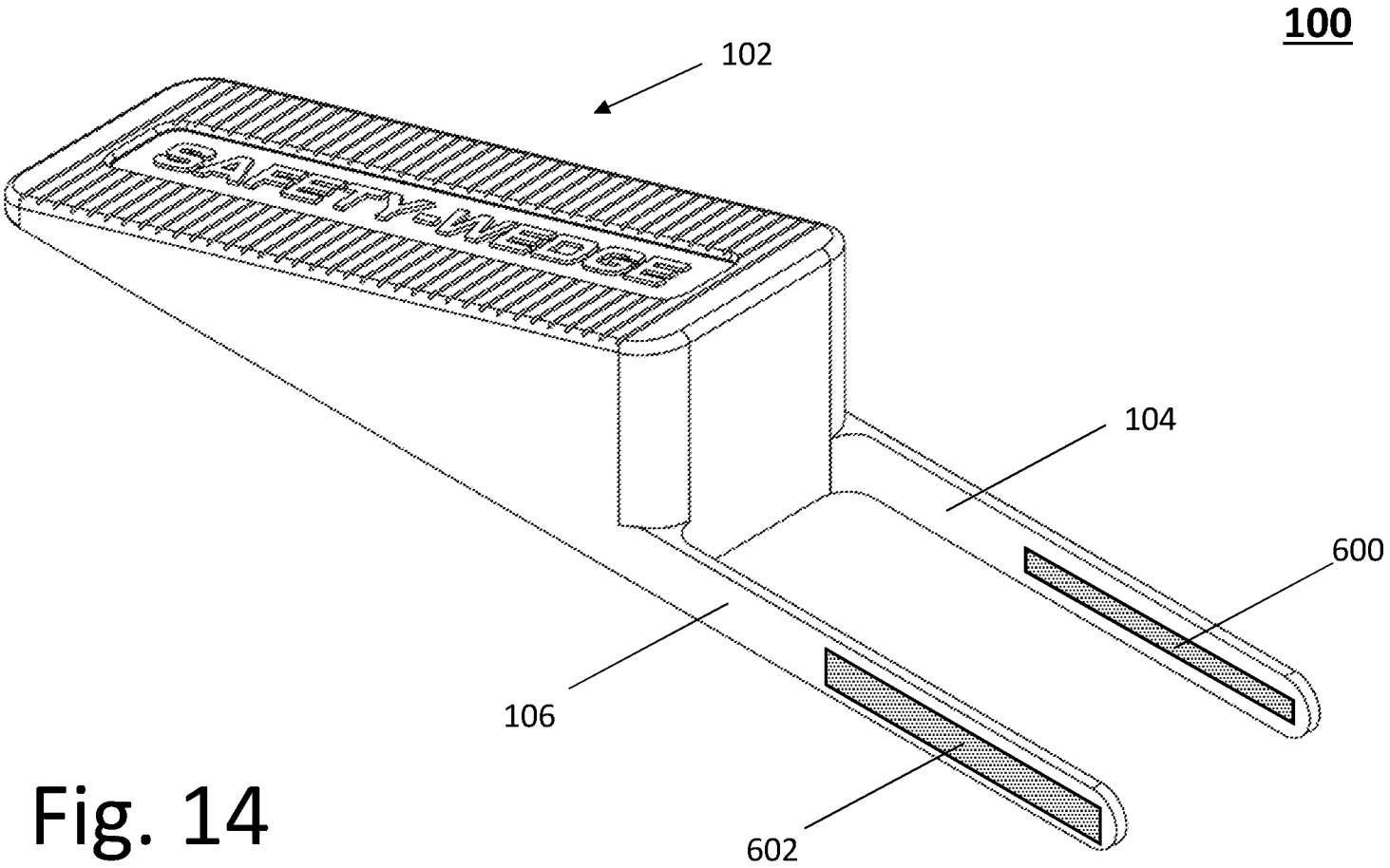
FIG. 14 is a perspective view of a door step of the present invention, in which the first arm includes a first strip of a hook-and-loop fastener along a face of the first arm, while the second arm includes a second strip of a hook-and-loop fastener configured for engaging with the first strip for joining to the first arm 104.

According to some embodiments of the present invention, as illustrated in FIG. 14, the first arm 104 includes a first strip 600 of a hook-and-loop fastener along a face of the first arm 104, while the second arm 106 includes a second strip 602 of a hook-and-loop fastener configured for engaging with the first strip 600 for joining to the first arm 104.

It should be noted that the hole and bulge example described in FIGS. 1-12, the snapping buttons example described in FIG. 13, and the hook-and-loop example of FIG. 14 are a non-limiting example of the engaging mechanism for detachably joining the first and second arms. Any other mechanism may be used and are within the scope of the present invention.

In some embodiments of the present invention, the door stop 100 is made using injection molding. In injection molding, the rubber material is fed into a hopper, which feeds into an extruder. An extruder screw pushes the rubber through the heating chamber in which the material is then melted. At the end of the extruder, the molten rubber is forced at high pressure into a closed cold mold. The high pressure is needed to be sure the mold is completely filled. Once the rubber cools to a solid, the mold opens and the finished product is ejected.

Optionally, the arms 104 and 106 are integral with the wedge shaped unit 102. Alternatively, the arms 104 and 106 are fabricated separately from the wedge shaped unit and are joined to the wedge shaped unit 102.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. A portable door stop comprising:

a wedge shaped unit having a tapered front end and an enlarged back end and tapering from the back end to the front end;

a first arm having a first proximal end and a first distal end; and a second arm having a second proximal end and a second distal end;

the first proximal end and the second proximal end attached directly to an end of the wedge shaped unit without any other objects or shapes between said wedge shaped unit and said first and second proximal ends;

the wedge shaped unit, the first arm, and the second arm are formed as a single integral structure, the first and second arms extending away from the wedge shaped unit and moveable between an engaged position in which the first distal end and the second distal end are connected to form a loop and a disengaged position in which the first distal end and the second distal end are spaced apart from each other in parallel along their entire respective lengths;

wherein the wedge shaped unit is configured for being pushed in a gap between a door and a floor under the door to prevent the door from moving, and the first and second arms are configured for enabling the portable door stop to be removably joined to a desired object by forming the loop around a portion of the desired object.

2. The portable door stop of claim 1, wherein:

the first distal end has an elastic section comprising an opening with a first dimension;

the second distal end comprises a bulge having a second dimension larger than the first dimension of the opening;

the first arm and the second arm are joined by causing the bulge to cross the opening, thereby causing the opening to expand while the bulge is in the opening and to contract back to the first dimension after the bulge has exited the opening.

3. The portable door stop of 1, wherein the door stop is made of a rubber material.

4. The portable door stop of claim 3, wherein the door stop is fabricated via injection molding.

5. The portable door stop of claim 1, wherein the first arm and the second arm are fabricated separately from the wedge shaped unit and are joined to the wedge shaped unit.

6. The portable door stop of claim 1, wherein the first arm or the second arm extends away from any one of: the front end of the wedge shaped unit, the back end of the wedge shaped unit, a top of the wedge shaped unit, a side wall of the wedge shaped unit, and a bottom of the wedge shaped unit.

7. The portable door stop of claim 1, wherein:

the first arm comprises one or more buttons extending away from a face of the first arm; and the second arm comprises one or more holes configured for removably engaging with the one or more buttons, in order to removably join the second arm with the first arm.

8. The portable door stop of claim 1, wherein:

the first arm comprises a first strip of a hook-and-loop fastener joined to a face of the first arm; and the second arm comprises a second strip the hook-and-loop fastener configured to engage with the first strip for removably joining the second arm to the first arm.

* * * * *